US010563280B2

(12) United States Patent
Kim et al.

(10) Patent No.: US 10,563,280 B2
(45) Date of Patent: Feb. 18, 2020

(54) HIGH MANGANESE STEEL SHEET HAVING HIGH STRENGTH AND EXCELLENT VIBRATION-PROOF PROPERTIES AND METHOD FOR MANUFACTURING SAME

(71) Applicant: POSCO, Pohang-si, Gyeongsangbuk-do (KR)

(72) Inventors: Sung-Kyu Kim, Gwangyang-si (KR); Kwang-Geun Chin, Gwangyang-si (KR); Tae-Jin Song, Gwangyang-si (KR); Tai-Ho Kim, Gwangyang-si (KR); Won-Tae Cho, Gwangyang-si (KR); Sun-Ho Jeon, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 384 days.

(21) Appl. No.: 15/030,830

(22) PCT Filed: Dec. 24, 2013

(86) PCT No.: PCT/KR2013/012085
§ 371 (c)(1),
(2) Date: Apr. 20, 2016

(87) PCT Pub. No.: WO2015/060499
PCT Pub. Date: Apr. 30, 2015

(65) Prior Publication Data

US 2016/0244857 A1 Aug. 25, 2016

(30) Foreign Application Priority Data

Oct. 23, 2013 (KR) ..... 10-2013-0126520

(51) Int. Cl.
*C22C 38/00* (2006.01)
*C21D 9/46* (2006.01)
(Continued)

(52) U.S. Cl.
CPC ..... *C21D 9/46* (2013.01); *B21B 3/00* (2013.01); *C21D 6/005* (2013.01); *C21D 8/02* (2013.01);
(Continued)

(58) Field of Classification Search
None
See application file for complete search history.

(56) References Cited

U.S. PATENT DOCUMENTS 5,290,372 A 3/1994 Choi et al.
5,634,990 A 6/1997 Choi et al.
(Continued)

FOREIGN PATENT DOCUMENTS

CN 101871075 A 10/2010
CN 102212746 A 10/2011
(Continued)

OTHER PUBLICATIONS

Extended European Search Report dated Sep. 15, 2016 issued in European Patent Application No. 13896046.3.
(Continued)

*Primary Examiner* — Erin B Saad
(74) *Attorney, Agent, or Firm* — Morgan, Lewis & Bockius LLP

(57) ABSTRACT

The present invention relates to a high-strength and high-manganese steel sheet suitable for an outer panel or a vehicle body of a transport vehicle and, more specifically, to a high-strength and high-manganese steel sheet having excellent vibration-proof properties and a method for producing the same.

3 Claims, 4 Drawing Sheets

INVENTIVE STEEL 4

COMPARATIVE STEEL 1

(51) Int. Cl.

| | |
|---|---|
| ***C22C 38/04*** | (2006.01) |
| ***C21D 6/00*** | (2006.01) |
| ***C21D 8/02*** | (2006.01) |
| ***B21B 3/00*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C21D 8/0226* (2013.01); *C21D 8/0236* (2013.01); *C21D 8/0273* (2013.01); *C22C 38/001* (2013.01); *C22C 38/002* (2013.01); *C22C 38/04* (2013.01); *C22C 38/06* (2013.01); *C22C 38/12* (2013.01); *C22C 38/14* (2013.01); *C21D 2211/001* (2013.01); *C21D 2211/008* (2013.01)

(56) References Cited

U.S. PATENT DOCUMENTS

| | | | | |
|---|---|---|---|---|
| 5,891,388 | A | 4/1999 | Baik et al. | |
| 2009/0010793 | A1 | 1/2009 | Becker et al. | |
| 2009/0202382 | A1 | 8/2009 | Kim et al. | |
| 2012/0125491 | A1* | 5/2012 | Meurer | C23C 2/02 148/533 |
| 2013/0295402 | A1* | 11/2013 | Oh | C21D 1/18 428/551 |
| 2014/0308156 | A1 | 10/2014 | Oh et al. | |
| 2015/0211088 | A1 | 7/2015 | Kim et al. | |

FOREIGN PATENT DOCUMENTS

| | | | |
|---|---|---|---|
| JP | 53-006222 | A | 1/1978 |
| JP | H04-232228 | A | 8/1992 |
| JP | H05-255813 | A | 10/1993 |
| JP | H07-150300 | A | 6/1995 |
| JP | H07-316738 | A | 12/1995 |
| JP | 04-272130 | B2 | 6/2009 |
| JP | 2009-521602 | A | 6/2009 |
| JP | 2010-043304 | A | 2/2010 |
| KR | 10-2007-0067950 | A | 6/2007 |
| KR | 10-2007-0085757 | A | 8/2007 |
| KR | 10-2011-0012367 | A | 2/2011 |
| KR | 10-2011-0072791 | A | 6/2011 |
| KR | 10-2013-0050138 | A | 5/2013 |
| WO | 2007/075006 | A1 | 7/2007 |
| WO | 2013/095005 | A1 | 6/2013 |

OTHER PUBLICATIONS

M. Tanaka, et al., "Effects of Grain Size and Microstructure on the Internalfriction and Young's Modulus of a High-Strength Steel HT-80," Journal of Materials Science, Kluwer Academic Publishers, Dordrecht, vol. 26, Aug. 15, 1991, pp. 4389-4393 (XP000602102).

Chinese Office Action dated Nov. 23, 2016 issued in Chinese Patent Application No. 201380080487.2 (with English translation).

N. Li, et al., "Effect of solution treatment on the damping capacity of Fe-14.04Mn-0.22C alloy," Heat Treatment of Metals, 2004, vol. 29, No. 5, pp. 20-23.

X. Yu, et al., "Influence of nitrogen on damping and mechanical properties of Fe—Mn alloys," Ordnance Material Science and Engineering, Jan. 2007, vol. 30, no. 1, pp. 63-65.

X. Yu, et al., "Damping capacity and corrosion resistance of Fe—Mn based damping alloys containing Ti," Heat Treatment of Metals, Apr. 2011, vol. 36, No. 4, pp. 69-71.

Japanese Office Action dated Jul. 4, 2017 issued in Japanese Patent Application No. 2016-526052.

International Search Report dated Jun. 25, 2014 issued in International Patent Application No. PCT/KR2013/012085.

* cited by examiner

【Figure 1】

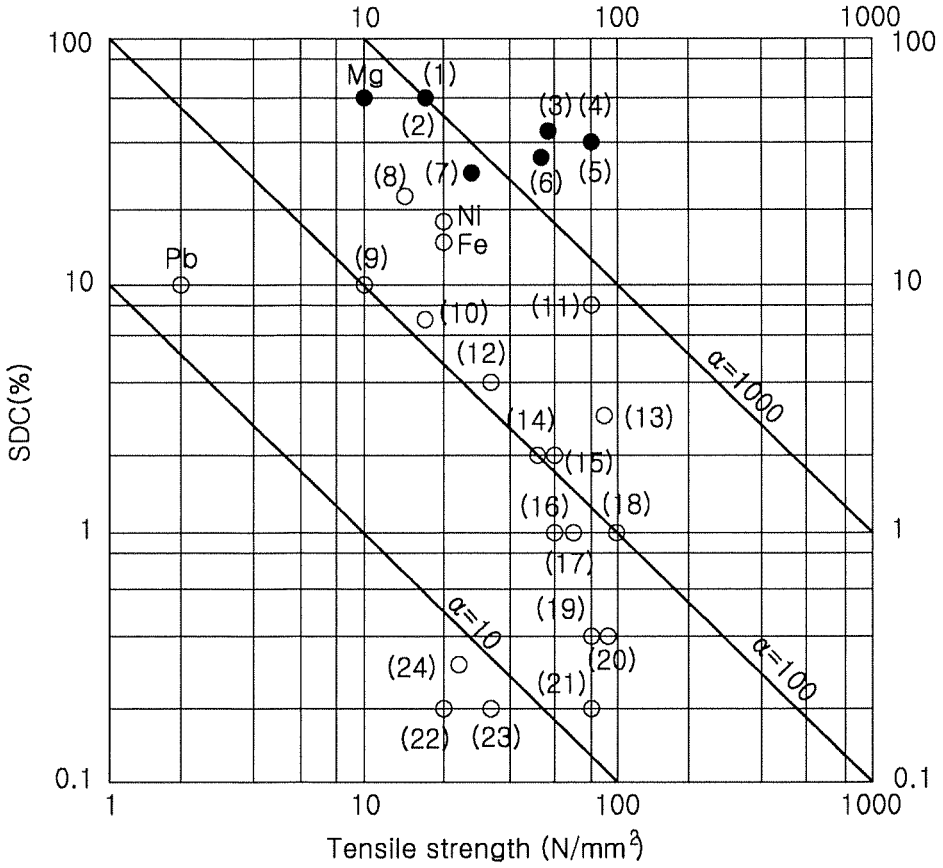

(1) Mg-Zr ALLOY
(2) Mg-MgNi ALLOY
(3) Mu-Cu ALLOY
(4) Cu-Al-Ni ALLOY
(5) Cu-Zn-Ni ALLOY
(6) Ti-Ni ALLOY
(7) Al-Zn ALLOY
(8) HIGH-CARBON, FLAKE-GRAPHITE CAST IRON (AUSTENITE MATRIX)
(9) FLAKE-GRAPHITE CAST IRON (FC-10)
(10) Mg ALLOY (AZ 81A)
(11) 12Cr STEEL I
(12) FERRITIC STAINLESS STEEL
(13) EXTRA MILD STEEL
(14) MALLEABLE CAST IRON
(15) NODULAR GRAPHITE CAST IRON
(16) 18-8 STAINLESS STEEL
(17) 0.45%C STEEL
(18) 0.95%C STEEL
(19) 0.65%C STEEL
(20) 0.80%C STEEL
(21) Al ALLOY (FOR CASTING)
(22) BRONZE
(23) BRASS
(24) Ti ALLOY

【Figure 2】
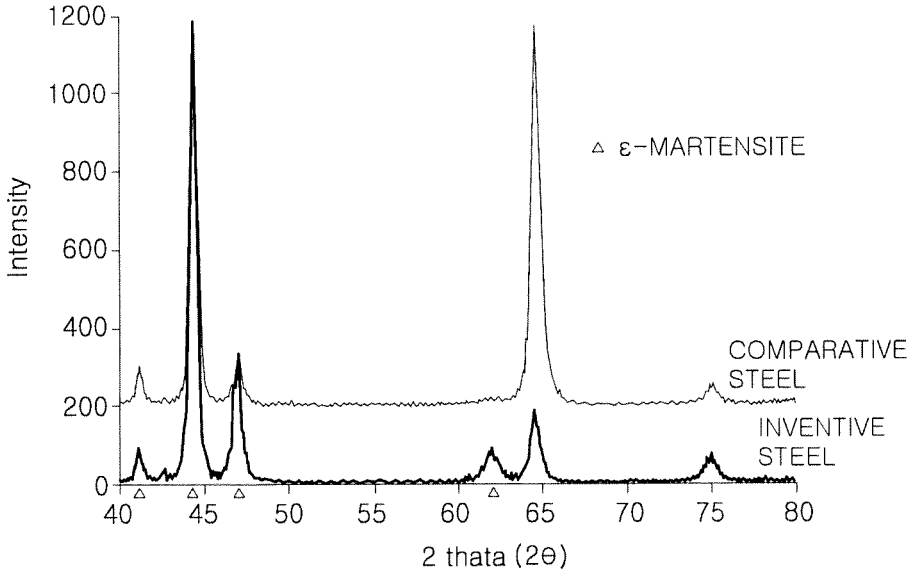

【Figure 3】
INVENTIVE STEEL 4
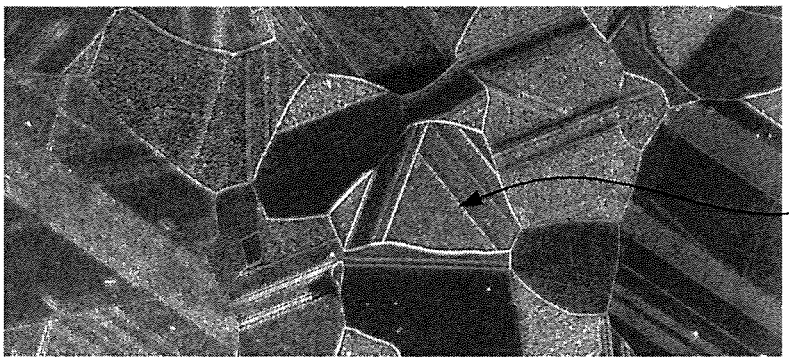
COMPARATIVE STEEL 1
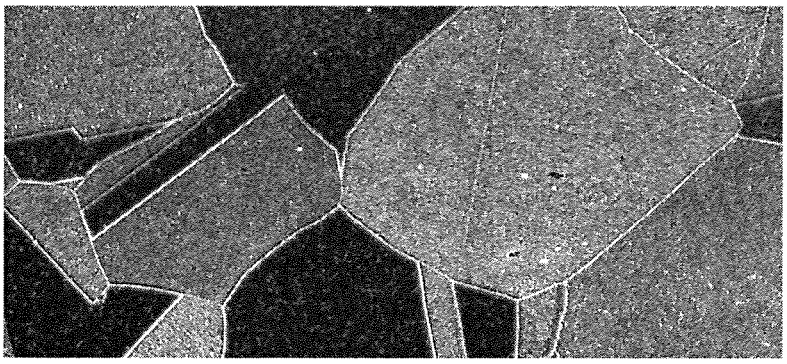

【Figure 4】
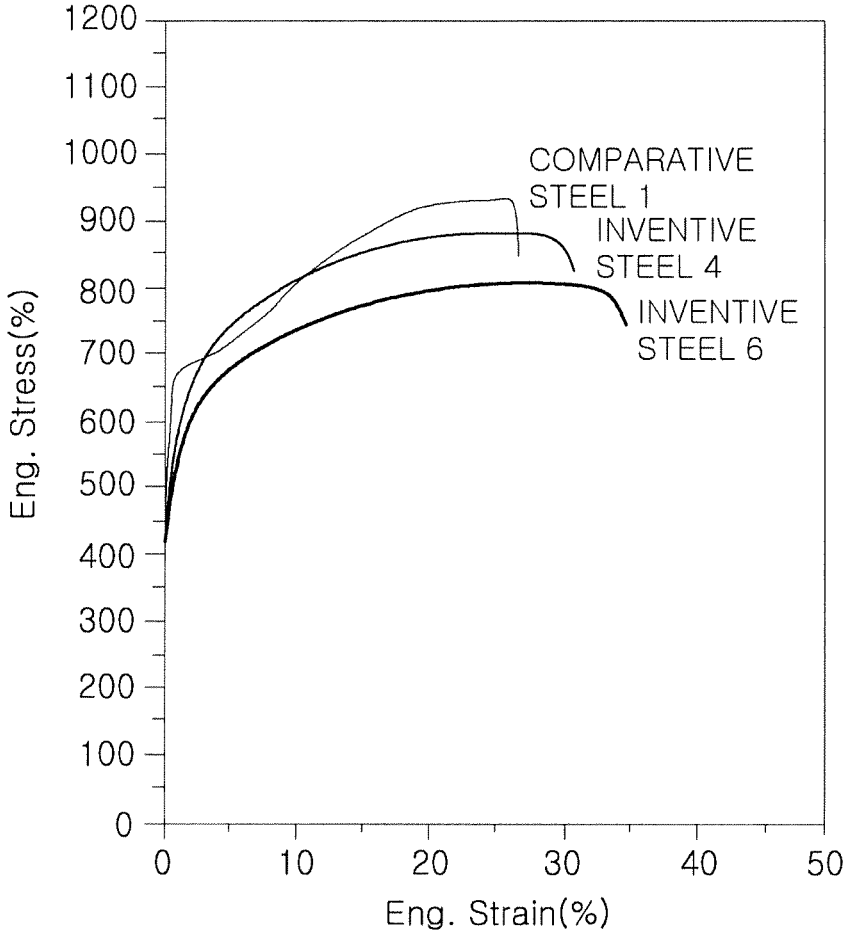

HIGH MANGANESE STEEL SHEET HAVING HIGH STRENGTH AND EXCELLENT VIBRATION-PROOF PROPERTIES AND METHOD FOR MANUFACTURING SAME

RELATED APPLICATIONS

This application is the U.S. National Phase under 35 U.S.C. § 371 of International Application No. PCT/KR2013/012085, filed on Dec. 24, 2013, which in turn claims the benefit of Korean Patent Application No. 10-2013-0126520 filed on Oct. 23, 2013, the disclosure of which applications are incorporated by reference herein.

TECHNICAL FIELD

The present disclosure relates to a high-strength, high-manganese steel sheet suitable for manufacturing the external panels or bodies of a means of transportation, and more particularly, to a high manganese steel sheet having high strength and improved vibration-proof properties and a method for manufacturing the high manganese steel sheet.

BACKGROUND ART

Noise and vibrations may cause emotional unease and diseases and may make people easily tired. In modern society, due to changes in lifestyles, the daily travel range of people has markedly increased on average, and thus people often spend a relatively large amount of time in various means of transportation. Therefore, noise and vibrations in a means of transportation have a large effect on quality of life.

Manufacturers of means of transportation such as automobiles commonly use high-strength steels to ensure the safety of passengers and reduce the weight of vehicles in line with environmental regulations. However, high-strength steels commonly have a low degree of formability, and thus it remains difficult to use high-strength steels for manufacturing a means of transportation.

In general, materials for a means of transportation are required to have high strength and formability. Thus, in the related art, advanced high strength steels (AHSS) including martensite, bainite, or retained austenite, such as dual phase steel, bainite steel, or transformation induced plasticity steel, have been used. However, the formability of AHSS is inversely proportional to strength, and the vibration damping capacity of AHSS is low.

Vibration damping capacity refers to the property of a material that absorbs vibrations. In general, if a material is vibrated, the material absorbs vibration energy and dampens vibrations. This is known as the vibration damping capacity or vibration-proof properties of a material. The vibration damping capacity of a material may be evaluated by measuring the amount of energy that a material is able to absorb. In this regard, a method of measuring internal friction is widely used.

In general, the vibration damping capacity of metals is inversely proportional to the strength of the metals, and thus it is difficult to increase both the strength and vibration damping capacity of metals. FIG. 1 illustrates a relationship between specific damping capacity (SDC) and tensile strength (TS). Referring to FIG. 1, as tensile strength increases, vibration damping capacity (specific damping capacity, SDC) decreases.

Although the use of high-strength materials in a means of transportation has been increasingly required by enhanced safety and environmental regulations, it remains difficult to use existing high-strength steels for manufacturing a means of transportation.

Materials such as cast iron have a high degree of vibration damping capacity. However, such materials are not suitable for manufacturing a means of transportation because bodies or external panels of a means of transportation are formed of plate-shaped materials. In addition, although materials such as plastics, aluminum, or magnesium have a high degree of vibration damping capacity, the use of such materials increases manufacturing costs.

DISCLOSURE

Technical Problem

Aspects of the present disclosure may provide a steel sheet having an optimized composition and thus high strength and improved vibration-proof properties, and a method for manufacturing the steel sheet.

Technical Solution

According to an aspect of the present disclosure, a high manganese steel sheet having high strength and improved vibration-proof properties may include, by wt %, manganese (Mn): 13% to 22%, carbon (C): 0.3% or less, titanium (Ti): 0.01% to 0.20%, boron (B): 0.0005% to 0.0050%, sulfur (S): 0.05% or less, phosphorus (P): 0.8% or less, nitrogen (N): 0.015% or less, and a balance of iron (Fe) and inevitable impurities, wherein the high manganese steel sheet has an internal friction $Q^{-1}$ of 0.001 or greater.

According to another aspect of the present disclosure, a method of manufacturing a high manganese steel sheet having high strength and improved vibration-proof properties may include:

reheating a steel slab having the above-described composition to a temperature within a range of 1100° C. to 1250° C.;

finish hot rolling the reheated steel slab at a temperature within a range of 800° C. to 950° C. to manufacture a hot-rolled steel sheet;

cooling and coiling the hot-rolled steel sheet at a temperature within a range of 400° C. to 700° C.;

pickling the coiled steel sheet;

cold rolling the pickled steel sheet at a reduction ratio of 30% to 60% to manufacture a cold-rolled steel sheet; and continuously annealing the cold-rolled steel sheet at a temperature within a range of 650° C. to 900° C.

Advantageous Effects

Exemplary embodiments of the present disclosure provide a high manganese steel sheet having a tensile strength of 800 MPa or greater and an elongation of 20% or greater, that is, a high degree of strength and a high degree of ductility. In addition, the high manganese steel sheet has a high degree of vibration damping capacity and thus vibration-proof properties.

In addition, the high manganese steel sheet of the exemplary embodiments may be usefully used for manufacturing a means of transportation or the like to impart vibration-proof properties thereto.

DESCRIPTION OF DRAWINGS

FIG. 1 is a graph illustrating a relationship between vibration damping capacity and tensile strength of alloys or steels.

FIG. 2 is a graph illustrating results of an X-ray diffraction analysis performed on Inventive Steel 4 and Comparative Steel 1.

FIG. 3 is a view illustrating microstructures of Inventive Steel 4 and Comparative Steel 1 observed using a scanning electron microscope.

FIG. 4 is a graph illustrating tensile strength curves of Inventive Steels 4 and 6 and Comparative Steel 1.

BEST MODE

The inventors have conducted a great deal of research into developing a steel sheet having improved vibration-proof properties that are difficult to impart to advanced high strength steels (AHSS) such as dual phase steel, bainite steel, or transformation induced plasticity steel which are known as high-strength steels in the related art. As a result of the research, the inventors found that if the stability of austenite of high manganese steel is improved by optimizing the contents of alloying elements of the high manganese steel, the high manganese steel has a high degree of strength, a high degree of vibration damping capacity, and non-magnetic properties. Based on this knowledge, the inventors have invented the present invention.

An exemplary embodiment of the present disclosure may provide a high manganese steel sheet having a high degree of strength and improved vibration-proof properties, the high manganese steel sheet including, by wt %, manganese (Mn): 13% to 22%, carbon (C): 0.3% or less, titanium (Ti): 0.01% to 0.20%, boron (B): 0.0005% to 0.0050%, sulfur (S): 0.05% or less, phosphorus (P): 0.8% or less, nitrogen (N): 0.015% or less, and a balance of iron (Fe) and inevitable impurities.

Hereinafter, reasons for limiting the contents (wt %) of alloying elements of the steel sheet of the exemplary embodiment will be described in detail.

Mn: 13% to 22%

Manganese (Mn) is an element stabilizing austenite. In particular, according to the exemplary embodiment, the formation of ε-martensite by decreasing stacking fault energy is required to ensure a high degree of vibration damping capacity. To this end, it may be preferable that manganese (Mn) be added in an amount of 13% or greater.

If the content of manganese (Mn) is less than 13%, α'-martensite may be formed, and thus the vibration damping capacity of the steel sheet may decrease. Conversely, if the content of manganese (Mn) is excessively high, that is, higher than 22%, manufacturing costs of the steel sheet may increase, and the steel sheet may have poor surface qualities because the steel sheet may undergo severe internal oxidation when being heated in a hot rolling process.

Therefore, according to the exemplary embodiment of the present disclosure, it may be preferable that the content of manganese (Mn) be within the range of 13% to 22%.

C: 0.3% or Less (Including 0%)

Carbon (C) added to steel stabilizes austenite and ensures strength as a solute element. However, if the content of carbon (C) in the steel sheet is greater than 0.3%, the vibration damping capacity of the steel sheet ensured by manganese (Mn) inducing the formation of ε-martensite is decreased. Therefore, it may be preferable that the content of carbon (C) be 0.3% or less.

Ti: 0.01% to 0.20%

Titanium (Ti) added to steel reacts with nitrogen (N) included in the steel and thus precipitates the nitrogen (N). In addition, titanium (Ti) dissolves in steel or forms precipitates, thereby reducing the size of gains.

To this end, it may be preferable that the content of titanium (Ti) be 0.01% or greater. However, if the content of titanium (Ti) in the steel sheet is greater than 0.20%, precipitation may occur excessively in the steel sheet, and thus the steel sheet may be finely cracked in a cold rolling process and may have poor formability and weldability. Therefore, the upper limit of the content of titanium (Ti) may preferably be 0.20%.

B: 0.0005% to 0.0050%

In the exemplary embodiment, a small amount of boron (B) is added to enhance grain boundaries of a steel slab. To this end, it may be preferable that the content of boron (B) be 0.0005% or greater. However, if the content of boron (B) is excessively high, manufacturing costs of the steel sheet increase. Thus, the upper limit of the content of boron (B) may preferably be 0.0050%.

S: 0.05% or Less

Sulfur (S) combines with manganese (Mn) and forms MnS as a non-metallic inclusion. The content of sulfur (S) may be adjusted to be 0.05% or less to control the formation of the non-metallic inclusion. If the content of sulfur (S) in the steel sheet is greater than 0.05%, the steel sheet may exhibit hot brittleness.

P: 0.8% or Less

Phosphorus (P) easily segregates and leads to cracks during a casting process. To prevent this, the content of phosphorus (P) may be adjusted to be 0.8% or less. If the content of phosphorus (P) in steel is greater than 0.8%, casting characteristics of the steel may be worsened.

N: 0.015% or Less

Nitrogen (N) reacts with titanium (Ti) or boron (B) and forms nitrides, thereby decreasing the size of grains. However, nitrogen (N) is likely to exist as free nitrogen (N) in steel, and if the content of nitrogen (N) is excessively high, vibration-proof properties are worsened. Therefore, preferably, the content of nitrogen (N) may be adjusted to be 0.015% or less.

The steel sheet of the exemplary embodiment may further include at least one of niobium (Nb) and vanadium (V) in addition to the above-described elements. In this case, the total content of titanium (Ti), niobium (Nb), and vanadium (V) (Ti+Nb+V) may preferably be within the range of 0.02% to 0.20%.

Like titanium (Ti), niobium (Nb) and vanadium (V) are effective carbide forming elements and are effective in decreasing the size of grains. Therefore, when at least one of niobium (Nb) and vanadium (V) is added in addition to titanium (Ti), it may be preferable that the total content of Ti+Nb+V be adjusted to be within the range of 0.02% to 0.20%.

If the total content of Ti+Nb+V is less than 0.02%, carbides may be insufficiently formed, and the effect of decreasing the size of grains may also be insufficient. Conversely, if the total content of Ti+Nb+V is greater than 0.20%, coarse precipitates may be adversely formed.

Besides the above-described elements, the steel sheet includes iron (Fe) and inevitable impurities. In the exemplary embodiment of the present disclosure, the addition of elements other than the above-described elements is not precluded.

Hereinafter, the microstructure of the steel sheet of the exemplary embodiment will be described in detail.

According to the exemplary embodiment of the present disclosure, the microstructure of the steel sheet having the above-described composition may include austenite and ε-martensite.

In the exemplary embodiment, the formation of ε-martensite is required to decrease stacking fault energy and thus to guarantee a high degree of vibration damping capacity. For example, if ε-martensite is included in an austenite matrix in an area fraction of 30% or greater, the steel sheet may have a high degree of vibration damping capacity and thus improved vibration-proof properties.

Particularly, according to the exemplary embodiment, highly stable austenite may be obtained owing to optimized contents of the alloying elements.

Therefore, the steel sheet of the exemplary embodiment may have high strength and high ductility. For example, the steel sheet may have a tensile strength of 800 MPa or greater and an elongation of 20% or greater.

In addition, the steel sheet of the exemplary embodiment may have a high degree of vibration damping capacity and improved vibration-proof properties. Particularly, the internal friction ($Q^{-1}$) of the steel sheet may be 0.001 or greater.

The vibration damping capacity of steel sheets may be measured by various methods. For example, in the exemplary embodiment, the vibration damping capacity of the steel sheet may be evaluated by measuring internal friction.

The internal friction of the steel sheet may be measured by vibrating a specimen of the steel sheet at a constant amplitude within a near-resonant-frequency range, plotting an amplitude-frequency curve, measuring a resonant frequency Fr and the half-width dF of a resonance peak from the amplitude-frequency curve having a bell shape, and calculating the internal friction $Q^{-1}$ of the specimen using the following formula.

$$Q^{-1}=dF/(3\ Fr)^{1/2} \quad \text{[Formula]}$$

In general, internal friction is measured using a dynamic method by vibrating a specimen. Such vibration methods using sinusoidal waves include a torsional vibration method and a transverse vibration method. In the exemplary embodiment of the present disclosure, the transverse vibration method in which an end of a specimen is impacted is used. In addition, internal friction may be evaluated at a frequency of 10 Hz, 10 Hz to 1000 Hz, or 1000 Hz or higher. In the exemplary embodiment of the present disclosure, internal friction is evaluated at a frequency of 100 Hz to 1000 Hz.

Hereinafter, a method for manufacturing a high manganese steel sheet having high strength and improved vibration-proof properties will be described in detail according to an exemplary embodiment of the present disclosure.

According to the exemplary embodiment, a steel sheet may be manufactured by performing a hot rolling process, a cold rolling process, and an annealing process on a steel slab having the above-described composition.

First, the steel slab having the above-described composition may be uniformly reheated to a temperature within a range of 1100° C. to 1250° C. before a hot rolling process is performed on the steel slab.

If the reheating temperature is too low, an excessively high rolling load may be applied to the steel slab in a subsequent hot rolling process. Therefore, it may be preferable that the steel slab be reheated to 1100° C. or higher. As the reheating temperature is high, the subsequent hot rolling process may be more easily performed. In the exemplary embodiment, however, the steel slab has a high manganese content, and thus internal oxidation may markedly occur, to result in poor surface qualities if the steel slab is reheated to an excessively high temperature. Therefore, the reheating temperature may preferably be 1250° C. or lower.

That is, according to the exemplary embodiment of the present disclosure, it may be preferable that the reheating temperature be within the range of 1100° C. to 1250° C.

The steel slab heated as described above may be subjected to a hot rolling process to form a hot-rolled steel sheet. In this case, it may be preferable that a finishing rolling temperature be within the range of 800° C. to 950° C.

In the hot rolling process, the steel slab may have low resistance to deformation as the finish rolling temperature is high. However, if the finish rolling temperature is too high, the surface quality of the hot-rolled steel sheet may be poor. Therefore, the finish hot rolling temperature may preferably be 950° C. or lower. Conversely, if the finish rolling temperature is too low, a hot rolling load may increase. Thus, it may be preferable that that the lower limit of the finish rolling temperature be 800° C.

That is, according to the exemplary embodiment of the present disclosure, it may be preferable that the finish hot rolling temperature be within the range of 800° C. to 950° C.

The hot-rolled steel sheet obtained as described above may be cooled using water and coiled. In this case, the coiling temperature may preferably be within the range of 400° C. to 700° C.

If the coiling process starts at an excessively low temperature, a large amount of cooling water may be used, and a large coiling load may be applied to the hot-rolled steel sheet. Therefore, the coiling process may start at a temperature of 400° C. or higher. Conversely, if the coiling process starts at an excessively high temperature, when the hot-rolled steel sheet is cooled after the coiling process, an oxide layer formed on the surface of the hot-rolled steel sheet may react with the matrix of the hot-rolled steel sheet, and thus, pickling characteristics of the hot-rolled steel sheet may be worsened. Therefore, the upper limit of the coiling temperature may preferably be 700° C.

That is, according to the exemplary embodiment of the present disclosure, it may be preferable that the coiling temperature be within the range of 400° C. to 700° C.

The coiled hot-rolled steel sheet may be pickled and cold rolled at a proper reduction ratio to form a cold-rolled steel sheet.

In general, the reduction ratio of a cold rolling process is determined according to the thickness of a final product. In the exemplary embodiment, however, recrystallization occurs in a heat treatment process after the cold rolling process, and thus it is required to control driving force of the recrystallization. If the reduction ratio of the cold rolling process is too low, the strength of a final product may decrease. Thus, the reduction ratio of the cold rolling process may preferably be 30% or greater. Conversely, if the reduction ratio of the cold rolling process is too high, the load of a roll rolling mill may excessively increase although the strength of the cold-rolled steel sheet increases. Therefore, the reduction ratio of the cold rolling process may preferably be 60% or less.

That is, according to the exemplary embodiment of the present disclosure, it may be preferable that the reduction ratio of the cold rolling process be within the range of 30% to 60%.

The cold-rolled steel sheet manufactured as described above may be subjected to a continuous annealing process.

The continuous annealing process may be performed within a temperature range in which recrystallization occurs sufficiently, preferably, 650° C. or higher. However, if the temperature of the continuous annealing process is too high, oxides may be formed on the cold-rolled steel sheet, and the workability of the cold-rolled steel sheet may be lowered. Therefore, the upper limit of the temperature of the continuous annealing process may preferably be 900° C.

That is, according to the exemplary embodiment of the present disclosure, it may be preferable that the temperature of the continuous annealing process be within the range of 650° C. to 900° C.

The steel sheet manufactured through the above-described processes may have a degree of tensile strength of 800 MPa or greater, an elongation of 20% or greater, and an amount of internal friction $Q^{-1}$ of 0.001 or greater. That is, the steel sheet may have a high degree of strength, a high degree of ductility, and improved vibration-proof properties.

[Mode for Invention]

Hereinafter, the present disclosure will be described more specifically according to examples. However, the following examples should be considered in a descriptive sense only and not for purpose of limitation. The scope of the present invention is defined by the appended claims, and modifications and variations may reasonably made therefrom.

EXAMPLES

Slabs having the compositions illustrated in Table 1 below were reheated to a temperature within a range of 1100° C. to 1200° C. and were hot rolled at a finish hot rolling temperature of 800° C. or higher so as to form hot-rolled steel sheets. Then, the hot-rolled steel sheets were coiled at a coiling temperature of 400° C. of higher. The coiled hot-rolled steel sheets were pickled and were cold rolled at a reduction ratio of 40% to 80% so as to form cold-rolled steel sheets. Then, the cold-rolled steel sheets were continuously annealed to a temperature of 750° C. or higher. In this manner, steel sheets were manufactured.

TABLE 1

| | Alloying elements (wt %) | | | | | | | | |
|---|---|---|---|---|---|---|---|---|---|
| Samples | C | Mn | P | S | Al | Ti | B | N | Nos. |
| 1 | — | 12.8 | 0.009 | 0.005 | — | 0.047 | 0.0013 | 0.006 | Comarpative Steel 1 |
| 2 | — | 15.3 | 0.010 | 0.007 | — | 0.059 | 0.0015 | 0.007 | Inventive Steel 1 |
| 3 | — | 15.9 | 0.010 | 0.006 | — | 0.045 | 0.0014 | 0.007 | Inventive Steel 2 |
| 4 | — | 16.9 | 0.010 | 0.007 | — | 0.016 | 0.0015 | 0.008 | Inventive Steel 3 |
| 5 | — | 16.6 | 0.099 | 0.006 | — | — | 0.0014 | 0.008 | Comarpative Steel 2 |
| 6 | — | 18.5 | 0.009 | 0.008 | — | 0.054 | 0.0015 | 0.007 | Inventive Steel 4 |
| 7 | — | 21.2 | 0.008 | 0.007 | — | 0.061 | 0.0014 | 0.007 | Inventive Steel 5 |
| 8 | 0.19 | 16.5 | 0.009 | 0.007 | — | 0.050 | 0.0015 | 0.008 | Inventive Steel 6 |
| 9 | 0.39 | 16.4 | 0.009 | 0.001 | — | 0.033 | 0.0015 | 0.008 | Comarpative Steel 3 |
| 10 | — | 16.8 | 0.010 | 0.006 | 2.3 | 0.077 | 0.0017 | 0.008 | Comarpative Steel 4 |
| 11 | — | 17.0 | 0.010 | 0.006 | 2.9 | 0.081 | 0.0018 | 0.008 | Comarpative Steel 5 |
| 12 | — | 16.7 | 0.010 | 0.007 | — | 0.030 | 0.0015 | 0.019 | Comarpative Steel 6 |
| 13 | 0.0021 | 0.4 | 0.003 | 0.006 | 0.1 | 0.020 | — | 0.004 | Comarpative Steel 7 |
| 14 | 0.21 | 2.5 | 0.002 | 0.005 | 0.01 | 0.020 | 0.0020 | 0.004 | Comarpative Steel 8 |
| 15 | 0.22 | 1.5 | 0.001 | 0.005 | 0.01 | 0.030 | — | 0.005 | Comarpative Steel 9 |

Thereafter, the yield strength YS, tensile strength TS, and elongation El of each of the steel sheets were measured as illustrated in Table 2 below. In addition, the above-described internal friction $Q^{-1}$ each steel sheet was measured as illustrated in Table 2 so as to evaluate the vibration damping capacity of each steel sheet.

TABLE 2

| Steels | YS (MPa) | TS (MPa) | El (%) | $Q^{-1}$ (damping) | Notes |
|---|---|---|---|---|---|
| Comarpative Steel 1 | 353.63 | 884.4 | 26.18 | 0.00088 | Comarpative Sample |
| Inventive Steel 1 | 383.63 | 937.8 | 22.23 | 0.00282 | Inventive Sample |
| Inventive Steel 2 | 462.61 | 805.11 | 29.29 | 0.011565 | Inventive Sample |
| Inventive Steel 3 | 482.68 | 810.16 | 26.22 | 0.012757 | Inventive Sample |
| Comarpative Steel 2 | 426.12 | 750.81 | 33.28 | 0.012632 | Comarpative Sample |
| Inventive Steel 4 | 488.03 | 883.75 | 25.13 | 0.007308 | Inventive Sample |
| Inventive Steel 5 | 411.32 | 822.65 | 33.14 | 0.002308 | Inventive Sample |
| Inventive Steel 6 | 467.13 | 1151.58 | 32.7 | 0.008155 | Inventive Sample |
| Comarpative Steel 3 | 514.34 | 1124.14 | 48.4 | 0.000053 | Comarpative Sample |
| Comarpative Steel 4 | 625.27 | 866.61 | 35.68 | 0.000134 | Comarpative Sample |
| Comarpative Steel 5 | 535.74 | 782.48 | 39.86 | 0.000089 | Comarpative Sample |
| Comarpative Steel 6 | 461.44 | 823.8 | 26.95 | 0.000282 | Comarpative Sample |
| Comarpative Steel 7 | 256 | 342 | 51 | 0.0016 | Comarpative Sample |
| Comarpative | 1003 | 1215 | 21 | 0.000116 | Comarpative |

TABLE 2-continued

| Steels | YS (MPa) | TS (MPa) | El (%) | $Q^{-1}$ (damping) | Notes |
|---|---|---|---|---|---|
| Steel 8 | | | | | Sample |
| Comarpative Steel 9 | 972 | 1516 | 7.8 | 0.000233 | Comarpative Sample |

As illustrated in Tables 1 and 2, inventive samples having compositions proposed in the exemplary embodiment of the present disclosure had high strength, high ductility, and high vibration damping capacity. That is, the inventive samples had improved vibration-proof properties.

However, comparative examples did not have compositions proposed in the exemplary embodiments of the present disclosure had low strength or low ductility, or even though the comparative samples had high strength and high ductility, the comparative samples had low vibration damping capacity, that is, poor vibration-proof properties.

In order to evaluate the microstructures of the inventive samples and the comparative samples, the microstructures of Inventive Steel 4 and Comparative Steel 1 were observed by an X-ray diffraction analysis method. Results of the observation are illustrated in FIG. 2.

As illustrated in FIG. 2, Inventive Steel 4 had a large amount of ε-martensite which is useful for guaranteeing vibration damping capacity. However, Comparative Steel 1 had a considerably low amount of ε-martensite compared to Inventive Steel 4.

In addition, samples of Inventive Steel 4 and Comparative Steel 1 were observed using a scanning electron microscope to evaluate the microstructures of the samples. Results of the observation are illustrated in FIG. 3.

As illustrated in FIG. 3, Inventive Steel 4 had a relatively high E-martensite fraction. However, Comparative Steel 1 had a relatively low ε-martensite fraction.

In addition, the slopes of tensile strength curves of Inventive Steels 4 and 6 and Comparative Steel 1 were observed. As illustrated in FIG. 4, each of the tensile strength curves of Inventive Steels 4 and 6 had a gradual slope while being deformed. However, the slope of the tensile strength curve of Comparative Steel 1 significantly varied because the Comparative Steel 1 underwent phase transformation while being deformed.

From these results, it could be understood that austenite and ε-martensite were formed in the inventive steels after or before the inventive steels were deformed.

The invention claimed is:

1. A high manganese steel sheet consisting of, by wt %, manganese (Mn): 13% to 22%, carbon (C): 0.3% or less, titanium (Ti): 0.01% to 0.20%, boron (B): 0. 0005% to 0. 0050%, sulfur (S) 0. 05% or less, phosphorus (P): 0.8% or less, nitrogen (N): 0.015% or less, and a balance of iron (Fe) and inevitable impurities, wherein the high manganese steel sheet has an internal friction $Q^{-1}$of 0.001or greater, in which $Q^{-1}=dF/(3Fr)^{1/2}$, wherein the high manganese steel sheet has a microstructure in which ε-martensite is included in an austenite matrix in an area fraction of 30% or greater, and wherein the high manganese steel sheet has a tensile strength of 800 MPa or greater.

2. The high manganese steel sheet of claim 1, wherein the high manganese steel sheet has an elongation of 20% or greater.

3. A method of manufacturing a high manganese steel sheet having high strength and improved vibration-proof properties, the method comprising:

reheating a steel slab to a temperature within a range of 1100° C. to 1250° C., the steel slab consisting of, by wt %, manganese (Mn): 13% to 22%, carbon (C): 0.3% or less, titanium (Ti): 0,01% to 0.20%, boron (B): 0,0005% to 0.0050%, sulfur (S): 0.05% or less, phosphorus (F): 0.8% or less, nitrogen (N): 0,015% or less, and a balance of iron (Fe) and inevitable impurities;

finish hot rolling the reheated steel slab at a temperature within a range of 800° C. to 950° C. to manufacture a hot-roved steel sheet; cooling and coiling the hot-rolled steel sheet at a temperature within a range of 400° C. to 100° C., pickling the coiled steel sheet;

cold rolling the pickled steel sheet at a reduction ratio of 30% to 60% to manufacture a cold-rolled steel sheet;

and continuously annealing the cold-rolled steel sheet at a temperature within a range of 650° C. to 900° C.;

wherein the high manganese steel sheet has an internal friction $Q^{-1}$ of 0.001 or greater, in which $Q^{-1}=dF/(3Fr)^{1/2}$, wherein the high manganese steel sheet has a microstructure in which ε-martensite is included in an austenite matrix in an area fraction of 30% or greater, and wherein the high manganese steel sheet has a tensile strength of 800 MPa or greater.

* * * * *